US007313347B2

(12) United States Patent
Shintani et al.

(10) Patent No.: US 7,313,347 B2
(45) Date of Patent: Dec. 25, 2007

(54) CLEANING DEVICE, PROCESS CARTRIDGE, IMAGE FORMING APPARATUS AND TONER

(75) Inventors: Takeshi Shintani, Kawasaki (JP); Takuzi Yoneda, Oota-ku (JP); Ken Amemiya, Nerima-ku (JP); Takaaki Tawada, Yokohama (JP); Tokuya Ojimi, Kawasaki (JP); Toshio Koike, Kawasaki (JP); Yuji Arai, Kawasaki (JP); Masanori Kawasumi, Yokohama (JP); Masami Tomita, Numazu (JP); Hideyo Watanabe, Yokohama (JP); Satoshi Takano, Bunkyou-ku (JP); Haruji Mizuishi, Oota-ku (JP); Hiroshi Ono, Oota-ku (JP); Hiroshi Mizusawa, Oota-ku (JP); Satoshi Hatori, Yokohama (JP); Takeshi Tabuchi, Kawaguchi (JP); Akira Fujimori, Yokohama (JP); Kaoru Yoshino, Urayasu (JP)

(73) Assignee: Ricoh Company Ltd., Tokyo (JP)

( * ) Notice: Subject to any disclaimer, the term of this patent is extended or adjusted under 35 U.S.C. 154(b) by 182 days.

(21) Appl. No.: 11/207,819

(22) Filed: Aug. 22, 2005

(65) Prior Publication Data

US 2006/0039726 A1 Feb. 23, 2006

(30) Foreign Application Priority Data

Aug. 23, 2004 (JP) ..... 2004-241876
Nov. 15, 2004 (JP) ..... 2004-330034

(51) Int. Cl.
*G03G 15/10* (2006.01)
*G03G 21/00* (2006.01)

(52) U.S. Cl. ..... 399/246; 399/343; 399/346; 399/350; 399/353

(58) Field of Classification Search ..... 399/343, 399/344, 346, 347, 349, 350, 352, 353, 246
See application file for complete search history.

(56) References Cited

U.S. PATENT DOCUMENTS 6,415,129 B2 * 7/2002 Sawayama ..... 399/353

(Continued)

FOREIGN PATENT DOCUMENTS

JP 10-260614 9/1998

(Continued)

OTHER PUBLICATIONS

U.S. Appl. No. 11/469,143, filed Aug. 31, 2006, Yoshino et al.

(Continued)

*Primary Examiner*—Hoang Ngo
(74) *Attorney, Agent, or Firm*—Oblon, Spivak, McClelland, Maier & Neustadt, P.C.

(57) ABSTRACT

A cleaning device, a process cartridge, an image forming apparatus, and toner to maintain improved cleaning performance for a long time. The cleaning device includes a cleaning blade, a lubricant applying part, and a toner removing part. The cleaning blade is disposed in contact with a surface of an image bearing member. The lubricant applying part coats a solid lubricant on the surface of the image bearing member, and is disposed in an upstream side from the cleaning blade with respect to a rotational direction of the image bearing member. The toner removing part removes toner particles, and is disposed in an upstream side from the lubricant applying part with respect to the rotational direction of the image bearing member.

31 Claims, 4 Drawing Sheets

U.S. PATENT DOCUMENTS

| | | | | |
|---|---|---|---|---|
| 7,050,741 | B2 * | 5/2006 | Koike et al. | 399/159 |
| 2004/0136763 | A1 | 7/2004 | Murakami et al. | |
| 2004/0141779 | A1 | 7/2004 | Yanagida et al. | |
| 2004/0170455 | A1 | 9/2004 | Shintani et al. | |
| 2004/0202495 | A1 | 10/2004 | Koike et al. | |
| 2004/0213597 | A1 | 10/2004 | Yanagida et al. | |
| 2004/0228648 | A1 | 11/2004 | Yanagida et al. | |
| 2005/0002705 | A1 | 1/2005 | Shintani et al. | |
| 2005/0025520 | A1 | 2/2005 | Murakami et al. | |
| 2005/0036805 | A1 | 2/2005 | Murakami et al. | |
| 2005/0074264 | A1 | 4/2005 | Amemiya et al. | |
| 2005/0084271 | A1 | 4/2005 | Koike et al. | |
| 2006/0039726 | A1 | 2/2006 | Shintani et al. | |

FOREIGN PATENT DOCUMENTS

| | | |
|---|---|---|
| JP | 2003-057996 | 2/2003 |
| JP | 2004-226685 | 8/2004 |

OTHER PUBLICATIONS

U.S. Appl. No. 11/512,385, filed Aug. 30, 2006, Tomita.
U.S. Appl. No. 11/450,401, filed Jun. 12, 2006, Ninomiya et al.
U.S. Appl. No. 11/685,660, filed Mar. 13, 2007, Shintani et al.

* cited by examiner

CLEANING DEVICE, PROCESS CARTRIDGE, IMAGE FORMING APPARATUS AND TONER

This document claims priority and contains subject matter related to Japanese Patent Applications Nos. 2004-241876 and 2004-330034, filed on Aug. 23, 2004 and on Nov. 15, 2004, respectively, the entire contents of each of which are hereby incorporated herein by reference.

BACKGROUND OF THE INVENTION

1. Field of the Invention

The present invention relates to a cleaning device incorporated in an electrophotographic image forming apparatus such as a copier, a printer, and a facsimile. In addition, the present invention also relates to an image forming apparatus and a process cartridge using the cleaning device, and a toner used in the cleaning device.

2. Discussion of the Background

An image forming apparatus, which uses an electrophotographic process, includes a photoconductor as an image bearing member, and operates to charge the surface of the photoconductor by discharging, to form an electrostatic latent image on the surface of the photoconductor by exposing, to develop the latent image by supplying toner to the surface of the photoconductor, to transfer the developed toner image onto a sheet, to fix the developed image on the sheet, and to then output the sheet. After transferring the developed image to the sheet, the surface of the photoconductor is cleaned with a cleaning device so that any residual toner does not exert a negative influence on the next image forming process. As a cleaning device, a cleaning blade including elastic bodies, such as rubber, to remove incrustations such as remaining toner is generally known.

Also, to enhance image quality, smaller diameter and higher roundness toner is being intensively designed at present. The purpose of using such toner is to make the toner bond to the electrostatic latent image more closely.

However, as known by those skilled in the art, high roundness toner has a poor cleaning characteristic in general. When such high roundness toner is cleaned up with a rubber blade, which is conventionally used to clean pulverized toner, it is difficult for the rubber blade to catch the high roundness toner particles at the blade edge thereof because of tumbling of the round particles. As a result, the high roundness toner particles tend to pass through the rubber blade. In addition, when such a cleaning blade is used, the life of the photoconductor surface shortens by wearing.

Thus, a technique that applies a lubricant to the photoconductor has been adopted to reduce frictional resistance between the photoconductor and cleaning blade, and to address a malfunction such as wearing of the cleaning blade. In addition, when a lubricant is applied to a photoconductor surface, the lubricant can prevent outbreak of so-called "filming" by reducing a coefficient of friction of the photoconductor surface. "Filming" is a phenomenon in which a fluidity agent or charge control agent added externally to the toner adheres to the photoconductor by abutment pressure with a cleaning blade. In addition, the reduction of adhesive power of the toner developed on the photoconductor with a photoconductor surface improves the transfer characteristics.

As for a mechanism to apply the lubricant to the photoconductor surface, for example, a solid lubricant made of such as fatty acid metal salts in the shape of a stick can be installed. And a brush roller is arranged to abut with the solid lubricant and photoconductor. By the lubricant application mechanism, the rotationally driven brush roller scrapes the solid lubricant, and supplies fine-grained lubricant to the surface of the photoconductor. Then, when the surface of the photoconductor is in contact with the cleaning blade, the lubricant is spread in a thin film to lower the frictional coefficient of the surface of the photoconductor.

However, when a residual toner on the surface of the photoconductor bonds to an application brush of the lubricant application mechanism, application efficiency of a lubricant deteriorates. Also, lubricant application is not stable, and thus it becomes difficult to address the above problem. In addition, the unstableness of an application quantity of a lubricant applied to a photoconductor surface produces unevenness of application, causes cleaning defectiveness on a part at which the lubricant is not applied enough, and causes abrasion of a cleaning member such as cleaning blade.

Thus, it is important that the lubricant of an appropriate quantity is applied to a photoconductor surface stably. Japanese Patent Laid-Open No. 10-260614 discloses a method of prescribing a density of fibers of a brush roller applying a lubricant. And Japanese Patent Laid-Open No. 2003-57996 discloses a method of prescribing the pressure of a pressure application member that is pressing the solid lubricant against the brush roller side, and prescribing a quantity of the brush roller sinking into the photoconductor surface.

SUMMARY OF THE INVENTION

It is a general object of the present invention to provide a novel cleaning device in which one or more of the above-mentioned problems are eliminated.

A first more specific object of the present invention is to provide a novel and improved cleaning device that can maintain good performance of cleaning over a long term.

A second more specific object of the present invention is to provide a novel process cartridge and an image forming apparatus that includes the cleaning device.

A third more specific object of the present invention is to provide novel toner preferably used for the process cartridge and the image forming apparatus.

To achieve the above-mentioned and other objects, there is provided according to one non-limiting aspect of the present invention a cleaning device configured to clean a surface of an image bearing member, including: a cleaning blade disposed in contact with the surface of the image bearing member; a lubricant applying part configured to apply a solid lubricant to the surface of the image bearing member, the lubricant applying part disposed in an upstream side from the cleaning blade with respect to a rotational direction of the image bearing member; and a toner removing part configured to remove toner particles, the toner removing part disposed in an upstream side from the lubricant applying part with respect to the rotational direction of the image bearing member.

Additionally, there is provided according to another non-limiting aspect of the present invention a process cartridge for an image forming apparatus wherein the process cartridge is detachably mounted in the image forming apparatus, the process cartridge including: an image bearing member bearing a latent image; and the above-mentioned cleaning device.

Additionally, there is provided according to another non-limiting aspect of the present invention an image forming apparatus including the above-mentioned cleaning device.

Additionally, there is provided according to another non-limiting aspect of the present invention toner for a development of an electrophotography process of an image forming apparatus including the above-mentioned cleaning part, wherein each particle of the toner has an average roundness greater than or equal to 0.93 and smaller than or equal to 1.0.

According to benefits realized by the present invention, it is possible to provide a cleaning device that can have and maintain improved cleaning performance over a long term even if polymerization toner is used.

Also, it is possible to provide a process cartridge and an image forming apparatus that can use the cleaning device therein to prevent cleaning malfunction of an image support body, thereby forming high-quality images.

Other objects, features, and advantages of the present invention will become more apparent from the following detailed description when read in conjunction with the accompanying drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
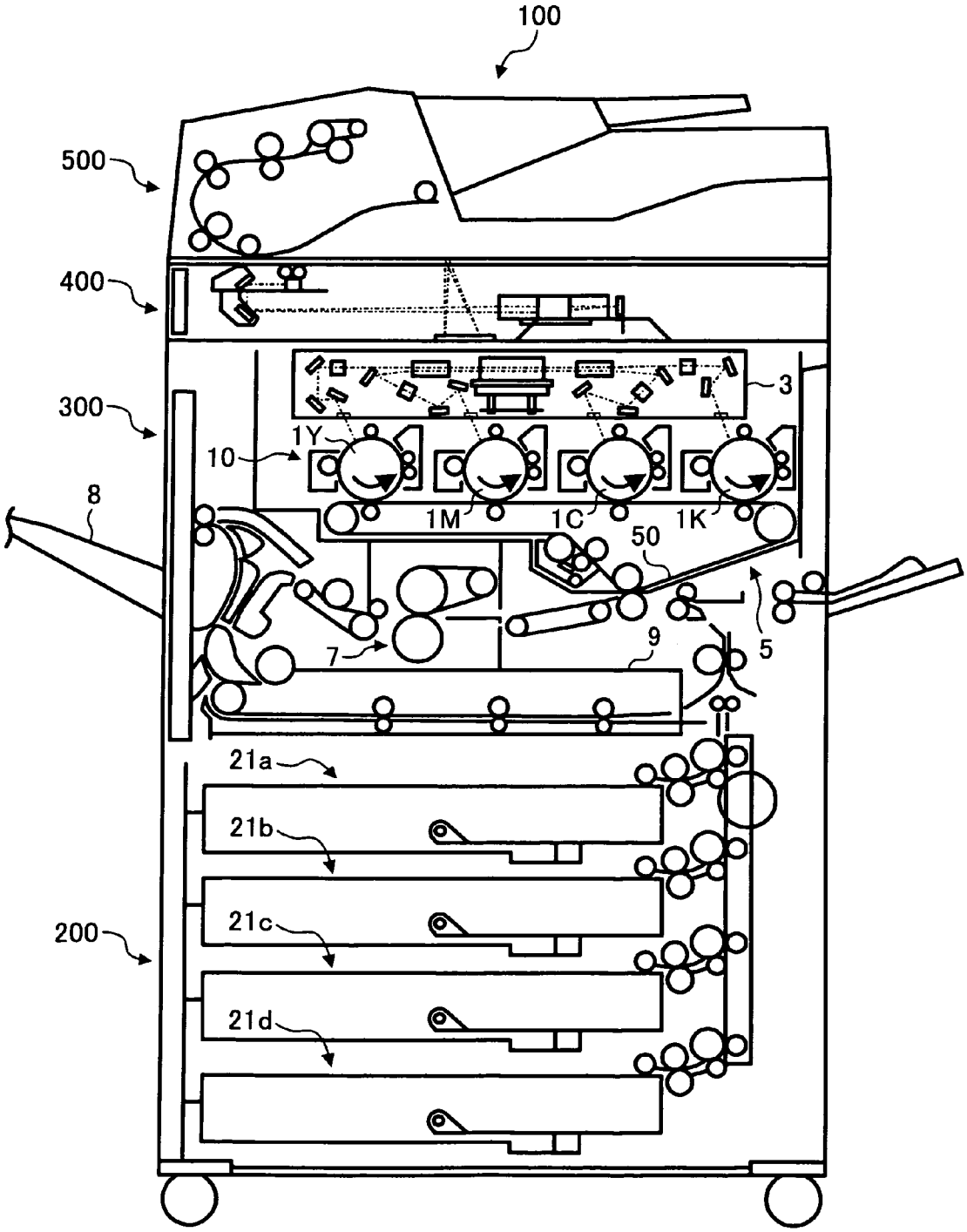
FIG. 1 shows an exemplary structure of an image forming apparatus according to an embodiment of the present invention.

A best mode for carrying out the present invention is explained below based on drawings and figures. In addition, the following discussion is an example of the best mode of this invention. The present invention is not limited to the specifically disclosed embodiments, and variations and modifications may be made without departing from the scope of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 shows an exemplary structure of an image forming apparatus according to an embodiment of the present invention. In the following, a full-color copier is used to exemplify this embodiment.

Referring to FIG. 1, an image forming apparatus 100 includes an image formation part 300, a paper supply part 200, a manuscript reading part 400, and a manuscript carrying part 500. The image formation part 300 includes an image formation unit 10, an exposing part 3, a transferring part 5, and a fixing part 7.

In the image formation unit 10, four units to form respective color toner images corresponding to black (K), cyan (C), magenta (M), and yellow (Y) are aligned, as illustrated in FIG. 1. The image formation unit 10 includes four photoconductors 1K, 1C, 1M, and 1Y corresponding to the four colors K, C, M, and Y, respectively. In the vicinity of each photoconductor, an electrifying part, a developing part, and a cleaning part are provided.

The exposing part 3 converts data read by the manuscript reading part 400 or image signals supplied from an external device (not illustrated) such as a PC (Personal Computer), and uses a polygon motor to conduct laser beam scanning. Then, the exposing part 3 forms electrostatic latent images on the photoconductors 1 based on scanning image signals via a mirror.

The transferring part 5 includes an immediate transfer belt 50 for superimposing respective color toner images on the four color photoconductors 1 sequentially and holding the superimposed images. Then, the color toner images on the immediate transfer belt 50 are transferred onto a recording paper. Alternatively, a recording paper is carried by a transfer carrier belt, and color toner images on the photoconductors 1 may be transferred onto the recording paper directly.

The fixing part 7 includes a pressure applying roller and a belt tensed by rollers incorporating a heat source such as a halogen heater. During passage through a nip part between the pair of rollers, heat and pressure are applied to the color toner image on the recording paper to fix the toner image. Alternatively, a pair of rollers or a pair of belts may be used in the fixing part 7.

The image forming apparatus 100 may optionally include a both-side reversing unit 9 and an output paper tray 8.

Figure 2:
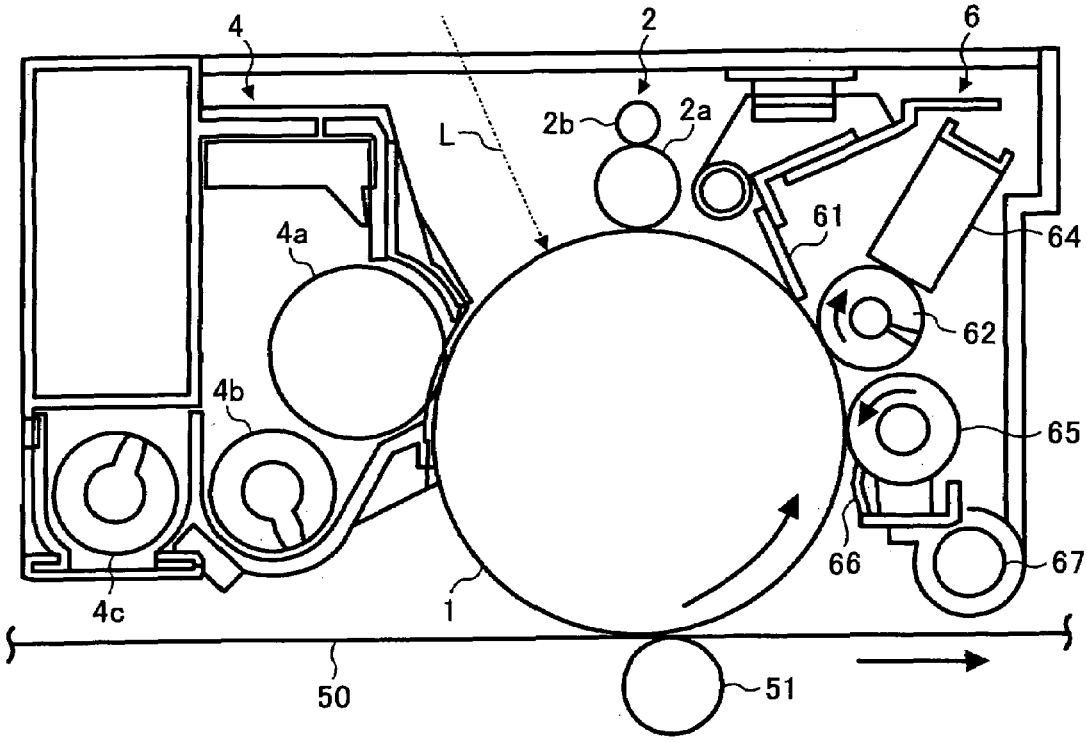
FIG. 2 is an enlarged view showing an image forming unit of the image forming apparatus shown in FIG. 1.

FIG. 2 is an enlarged view showing the image formation unit 10 shown in FIG. 1.

Referring to FIG. 2, the photoconductor 1 may be formed of a photoconductive amorphous metal such as amorphous silicon and amorphous selenium. Alternatively, the photoconductor 1 may be formed of organic compounds such as bisazo pigment and phthalocyanine pigment. If an environmental influence and postprocessing after use thereof are taken into account, an OPC photoconductor in use of an organic compound is preferred.

The electrifying or charging part 2 may be any of a corona type, a roller type, a brush type, and a blade type. In the illustration, the electrifying part 2 is configured from a roller type electrifying device. Also, the electrifying part 2 includes a power source (not illustrated) connected to an electrifying roller 2*a* and an electrifying roller cleaning member 2*b*, which is disposed in contact with the electrifying roller 2*a*, for the purpose of cleaning the electrifying roller 2*a*. When a high voltage is applied to the electrifying roller 2*a*, the surface of the photoconductor 1 is discharged uniformly between the electrifying part 2 and the photoconductor 1.

The developing part 4 includes a developer support body 4*a* to supply a developer supported thereon to the photoconductor 1 and a toner supply area 4*b*. The developer support body 4*a* is hollow-cylinder shaped and is rotatably supported. The developing support body 4*a* accommodates a magnet roller fixed to have the same rotational axis as the rotatable developer support body 4*a*. The developer is magnetically absorbed and carried on the outer circumferential surface of the developer support body 4*a*. The developer support body 4*a*, which is made of a conductive and non-magnetic member, is connected to a power source (not illustrated) for applying development bias. An electric field is formed in a development area by providing a voltage from the power source between the developer support body 4*a* and the photoconductor 1.

A primary transfer part 51 is disposed at a position opposite to the photoconductor 1 and that sandwiches the immediate transfer belt 50 with the photoconductor 1. The primary transfer part 51 is connected to a power source (not illustrated). When a toner image on the photoconductor 1 is to be transferred onto the immediate transfer belt 50, a voltage is applied to the primary transfer part 51. Then, an electric field is formed between the photoconductor 1 and the immediate transfer belt 50, and thereby the toner image is electrostatically transferred.

As shown in FIG. 2, a cleaning device 6 according to an embodiment of the present invention includes a cleaning blade 61, a lubricant applying part 62, and a toner removing part 65. The cleaning blade 61 is disposed in contact with the photoconductor 1. The lubricant applying part 62, which is disposed in the upstream side from the cleaning blade 61 with respect to the rotational direction of the photoconductor 1, scrapes an antifriction material from a solid lubricant material 64 and supplies the scraped lubricant material to the photoconductor 1. The toner removing part 65 is disposed at a further upstream side from the lubricant applying part 62 with respect to the rotational direction of the photoconductor 1. After completion of primary transferring, the toner removing part 65 removes remaining toner particles from the photoconductor 1. Then, the lubricant applying part 62 supplies particles scraped from the solid lubricant 64 to the photoconductor 1, and the cleaning blade 65 scrapes away the remaining toner and filming from the photoconductor 1.

Figure 3:
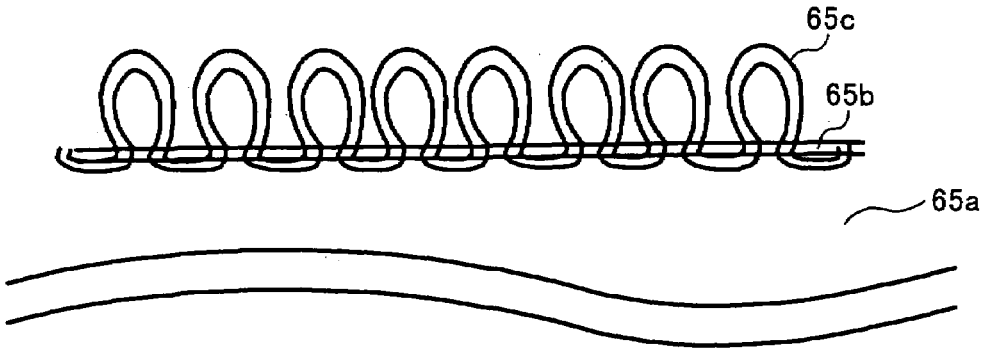
FIG. 3 shows an exemplary structure of a loop brush roller according to an embodiment of the present invention.

The toner removing part 65 can be configured from various mechanisms such as a rubber blade and a fur brush. Preferably, the toner removing part 65 is configured to have a loop brush roller and 65 and a flicker 66 to scrape away toner particles attached on the surface of the loop brush roller 65, as illustrated in FIG. 2. FIG. 3 shows an outline constitution of loop brush roller 65. As the loop brush roller 65, electroconductive brush fibers 65*c* are implanted in a basis cloth 65*b* so that the shape of the brush fiber becomes loop-like at the surface of the photoconductor 1. And the basis cloth 65*b* is wound around a core 65*a* to form the brush, and is grounded. Because of the loop shape, photoconductor 1 is prevented from being worn by the tip of brush fibers 65*c*. In addition, by grounding, the loop brush roller 65 is prevented from being charged.

The loop brush roller 65 rotates in a counter (opposite) direction to a rotating direction of photoconductor 1 at the point where the photoconductor 1 contacts the loop brush roller 65. Because of this structure, residual toner of the photoconductor and "filming" can be removed effectively.

In addition, when the contacting of the flicker 66 with the loop brush roller 65 is released, the surface of the brush fibers 65*c* is cleaned by such phenomenon that the residual toner on the surface of the brush fibers 65*c* is flicked out by the power of centrifugal force. Even more particularly, the phenomenon can prevent the brush fibers 65 from being tense due to the toner in the brush fibers 65*c* being crushed by contact with photoconductor 1 and increasing of a drive load torque.

As shown in FIG. 2, it is preferable that the lubricant applying part 62 be embodied as a brush roller. A solid lubricant material 64 is in contact with the brush roller 62 due to the weight thereof or an external depression force. The solid lubricant material 64 may be made of an aliphatic metal salt such as lead oleate, zinc oleate, cupper oleate, zinc stearate, cobalt stearate, iron stearate, cupper stearate, zinc palmitate, cupper palmitate, and zinc linolenate. In particular, the solid lubricant material 64 is preferably made of zinc stearate.

The rotationally driven brush, roller 62 scrapes the solid lubricant material 64, and supplies the fine-grained lubricant material to the surface of the photoconductor 1. Then, when the surface of the photoconductor 1 is in contact with the cleaning blade 61, the lubricant material is spread in a thin film to lower the frictional coefficient of the surface of the photoconductor 1.

Figure 4:
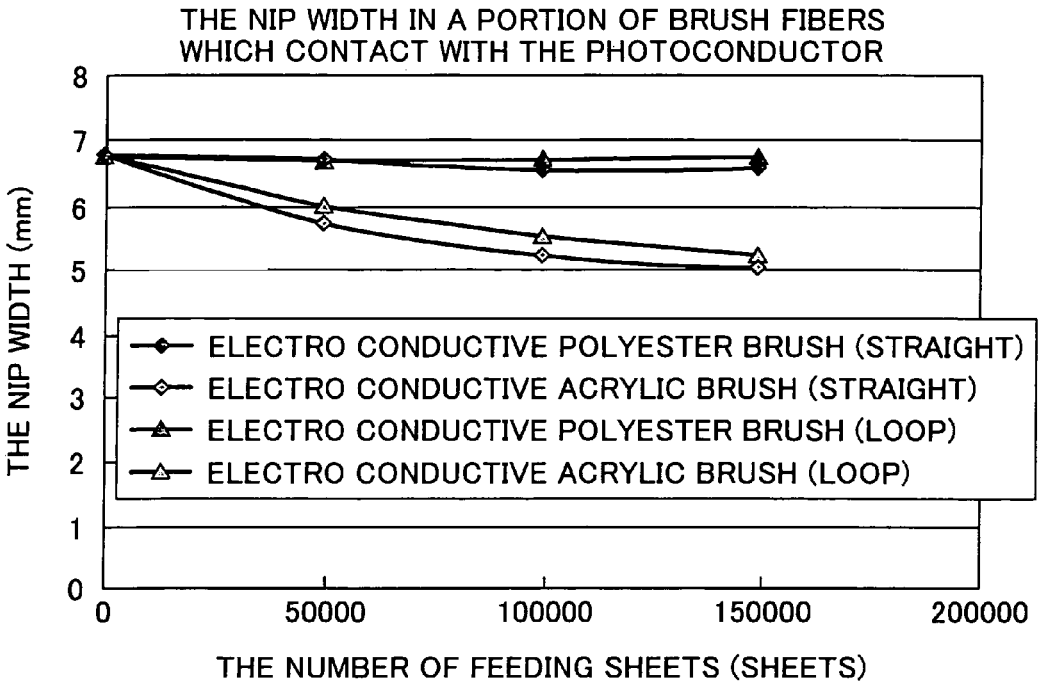
FIG. 4 is a graph illustrating relationships between a number of feeding sheets and nip width in a portion of brush fibers that contact the photoconductor.

FIG. 4 is a figure showing a change timewise of the nip width in a portion where the brush fibers 65*c* contact the photoconductor 1. As shown in FIG. 4, the brush fibers 65*c* of the brush roller 62 and the loop brush roller 65 are preferably made of an electroconductive polyester brush, to maintain their initial ability over a long term. That brush hardly bends over time, which results in few changes of the nip width in the photoconductor contact region. In addition, as for the resistance value of a brush, a low resistance is desirable to be able to contact as a ground. In accordance with exemplary embodiments, the brush is formed by materials adjusted to a volume specific resistance $1\times10^4$~$1\times10^6$ O·CM.

Preferably, the brush roller 62 is rotationally driven in the same direction with respect to the rotation direction of the photoconductor 1. Since the cleaning device 6 includes the loop brush roller 65, which serves as toner removing mechanism, in the upstream side from the brush roller 62 with respect to the rotational direction of the photoconductor 1, one of the main purposes of the brush roller 62 is to coat the solid lubricant material 64 on the surface of the photoconductor 1. If the toner collection function of the brush roller 62 has priority, it is desirable that the brush roller 62 is rotationally driven in the opposite direction with respect to the rotation direction of the photoconductor 1. However, for the above-mentioned reason, the brush roller 62 is rotationally driven in the same direction with respect to the rotation direction of the photoconductor 1, which is preferable for applying the solid lubricant material 64.

In addition, the present invention is not limited to the example that adopts the straight brush as the lubricant application mechanism, and the loop brush roller as the toner removal mechanism. When the ability of the toner removal mechanism to scratch the toner, which is bonded to the photoconductor, is raised by hardening the toner removal mechanism more than the lubricant application mechanism, or improving the brush density, the effect of the invention is provided.

A process cartridge integrally supporting the cleaning device 6 and the photoconductor 1 can be configured to be detachably mounted in an image forming apparatus. Such a process cartridge may additionally include the electrifying part 2 and/or the developing part 4. Even in an image formation process in which high roundness and small diameter toner is used to form images, the process cartridge can properly clean up the photoconductor 1 and suppress degradation of image quality. Also, since the process cartridge can keep good cleaning performance thereof over a long term, it is possible to extend the life span of the process cartridge.

Now, the volume average particle diameter and the number average particle diameter of toner, which will be understood by those skilled in the art, are notated as Dv and Dn, respectively. Then, even if toner having a small particle diameter and a concentrated particle diameter distribution, such as toner having a Dv value of 3 through 8 μm and a ratio (Dv/Dn) of 1.00 through 1.40, is used, the cleaning device 6 performs well. Such concentrated particle distribution causes a uniform electrification distribution, thereby resulting in high-quality fog-free images and achieving an improved transfer rate. According to a background blade type cleaning, it is difficult to satisfactorily clean up toner particles due to a strong adhesion force between the toner particles and the photoconductor 1. Also, since a small particle diameter toner tends to contain relatively large external additive particles, desorption of such additive particles from the toner is likely to cause filming on the photoconductor 1. However, when the brush roller 62 of the cleaning device 6 properly coat a lubricant material on the surface of the photoconductor 1, it is possible to lower the frictional coefficient of the surface of the photoconductor 1 and improve the cleaning performance of the cleaning blade 61.

In addition, the cleaning device 6 is preferably applicable to cleaning of almost round toner particles. In general, round toner can be defined by shape factors SF-1 and SF-2 described in detail below. Toner having the shape factor SF-1 of 100 through 180 and the shape factor SF-2 of 100 through 180 can be used in an image forming apparatus according to an embodiment of the present invention.

Figure 5A:
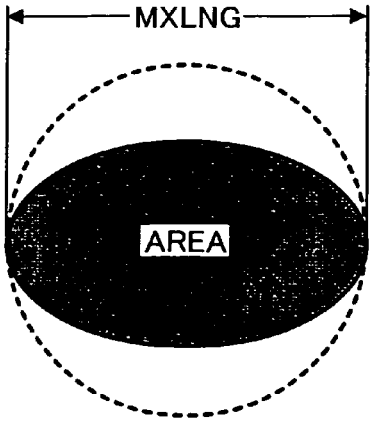
FIGS. 5A and 5B are schematic views showing exemplary toner shapes for the purpose of explaining shape coefficients SF-1 and SF-2.
Figure 5B:
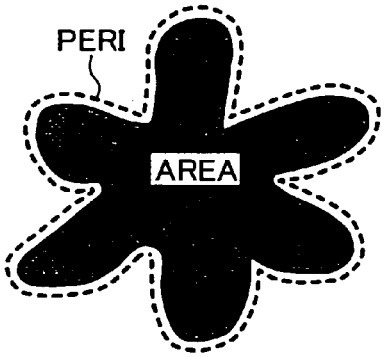

FIGS. 5A and 5B are schematic diagrams showing exemplary shapes of toner particles for explaining the shape factors SF-1 and SF-2.

Referring to FIG. 5A, the shape factor SF-1 represents roundness of a toner particle. The shape factor SF-1 is formulated as follows:

$$SF\text{-}1=\{(\mathrm{MXLNG})^2/\mathrm{AREA}\}\times(100\ p/4) \quad (1),$$

where MXLNG represents the maximum length of the two-dimensionally projected shape of the toner particle, and AREA represents the area of the projected shape. If the SF-1 value of toner is equal to 100, the toner has true roundness. As SF-1 becomes larger, the toner has a more indeterminate form.

Referring to FIG. 5B, on the other hand, the shape factor SF-2 represents convexity and concavity of a toner particle. The shape factor SF-2 is formulated as follows:

$$SF\text{-}2=\{(\mathrm{PERI})^2/\mathrm{AREA}\}\times(100\ p/4) \quad (2),$$

where PERI represents the peripheral length of the two-dimensionally projected shape of the toner particle. If the SF-2 value is equal to 100, the surface of the toner particle has no convexity and concavity at all. As SF-2 becomes larger, the surface of the toner particle has increased convexity or concavity.

To measure the shape factors, the toner particle is filmed, for example with a scanning type electron microscope (S-880 produced by Hitachi, Ltd.), and the obtained picture is analyzed, for example with an image analysis apparatus (LUSEX 3 produced by NIRECO Corporation).

As a toner particle has higher roundness, the toner particle is more likely to point-contact with another toner particle or the photoconductor 1. In this case, the adhesion force between these toner particles is weak, thereby making the toner particles highly flowable.

Also, while weak adhesion force between the round toner particle and the photoconductor enhances the transfer rate, the round toner is more likely to cause cleaning malfunction for blade type cleaning. However, in this case, the cleaning device 6 of the present invention can clean up the toner particles well. It is noted that large SF-1 and SF-2 values may deteriorate visual quality of an image due to scattered toner particles on the image. It is preferable that the SF-1 and SF-2 values be less than 180.

Toner for preferred use in an image forming apparatus according to the present invention is produced through bridge reaction and/or elongation reaction of a liquid toner material in aqueous solvent. Here, the liquid toner material is generated by dispersing polyester prepolymer including an aromatic group having at least nitrogen atom, polyester, a coloring agent, and a release agent in organic solvent. In the following, toner constituents and a toner manufacturing method are described in detail.

Modified Polyester

Toner according to an embodiment of the present invention includes modified polyester (i) as a binder resin. As the modified polyester (i), the polyester resin may include a bond group other than an ester bond. Also, in the polyester resin, different resin constituents may be covalent and/or ion bonded to each other. Specifically, the modified polyester may result from modification of polyester residues by introducing a functional group such as an isocyanate group reacted with a hydroxyl group and a carboxylic acid group to polyester residues and further reacting the resulting compound with an active hydrogen including compound.

The modified polyester (i) may be urea-modified polyester generated by reaction of polyester prepolymer (A) having an isocyanate group and an amine class (B). The polyester prepolymer (A) having an isocyanate group may be generated by reacting polyester, which is a polycondensation compound of polyalcohol (PO) and polycarboxylic acid (PC) and includes polyester having an active hydrogen group, to a polyisocyanate (PIC) compound. Such an active hydrogen group of the polyester may be a hydroxyl group (alcoholic-hydroxyl group and phenolic-hydroxyl group), an amino group, a carboxyl group, and a mercapto group.

Among these groups, the alcoholic-hydroxyl group is preferred.

The urea-modified polyester is generated as follows. A polyalcohol (PO) compound may be divalent alcohol (DIO) and tri- or more valent polyalcohol (TO). Only DIO or a mixture of DIO and a small amount of TO is preferred. The divalent alcohol (DIO) may be alkylene glycol (ethylene glycol, 1,3-propylene glycol, 1.4-butanediol, 1,6-hexanediol or the like), alkylene ether glycol (diethylene glycol, triethylene glycol, dipropyrene glycol, polyethylene glycol, polypropylene glycol, polytetramethylene ether glycol or the like), alicyclic diol (1,4-cyclohexane dimethanol, hydrogenated bisphenol A or the like), bisphenols (bisphenol A, bisphenol F, bisphenol S or the like), alkylene oxide adducts of above-mentioned alicyclic diols (ethylene oxide, propylene oxide, butylene oxide or the like), and alkylene oxide adducts of the above-mentioned bisphenols (ethylene oxide, propylene oxide, butylene oxide or the like).

Alkylene glycol having 2-12 carbon atoms and alkylene oxide adducts of bisphenols are preferred. In particular, the alkylene glycol having 2-12 carbon atoms and the alkylene oxide adducts of bisphenols are preferably used together. Tri- or more valent polyalcohol (TO) may be tri- to octa or more valent polyaliphatic alcohols (glycerin, trimethylolethane, trimethylol propane, pentaerythritol, sorbitol or the like), tri- or more valent phenols (trisphenol PA, phenol novolac, cresol novolac or the like), and alkylene oxide adducts of tri- or more valent polyphenols.

The polycarboxylic acid (PC) may be divalent carboxylic acid (DIC) and tri- or more valent polycarboxylic acid (TC).

Only DIC or a mixture of DIC and a small amount of TC is preferred. The divalent carboxylic acid (DIC) may be alkylene dicarboxylic acid (succinic acid, adipic acid, sebacic acid or the like), alkenylene dicarboxylic acid (maleic acid, fumaric acid or the like), and aromatic dicarboxylic acid (phthalic acid, isophthalic acid, terephthalic acid, naphthalene dicarboxylic acid or the like). Alkenylene dicarboxylic acid having 4-20 carbon atoms and aromatic dicarboxylic acid having 8-20 carbon atoms are preferred. Tri- or more valent polycarboxylic acid may be aromatic polycarboxylic acid having 9-20 carbon atoms (trimellitic acid, pyromellitic acid or the like). Here, the polycarboxylic acid (PC) may be reacted to the polyalcohol (PO) by using acid anhydrides or lower alkyl ester (methylester, ethylester, isopropylester or the like) of the above-mentioned materials.

A ratio of the polyalcohol (PO) and the polycarboxylic acid (PC) is normally set between 2/1 and 1/1 as an equivalent ratio [OH]/[COOH] of a hydroxyl group [OH] and a carboxyl group [COOH]. The ratio preferably ranges from 1.5/1 through 1/1. In particular, the ratio is preferably between 1.3/1 and 1.02/1.

A polyisocyanate (PIC) compound may be aliphatic polyisocyanate (tetramethylene diisocyanate, hexamethylene diisocyanate, 2,6-diisocyanate methylcaproate or the like), alicyclic polyisocyanate (isophoron diisocyanate, cyclohexyl methane diisocyanate or the like), aromatic diisocyanate (trilene diisocyanate, diphenylmethane diisocyanate or the like), aromatic aliphatic diisocyanate (&agr;, &agr;, &agr;', &agr; '-tetramethyl xylylene diisocyanate), isocyanates, materials blocked against the polyisocyanate with phenol derivative, oxime, caprolactam or the like, and combinations of two or more of these materials.

The ratio of the polyisocyanate (PIC) compound is normally set between 5/1 and 1/1 as an equivalent ratio [NCO]/[OH] of the isocyanate group [NCO] and the hydroxyl group [OH] of polyester having a hydroxyl group. The ratio is preferably between 4/1 and 1.2/1. In particular, the ratio is preferably between 2.5/1 and 1.5/1. If the ratio [NCO]/[OH] is greater than or equal to 5.0, the ratio degrades low temperature fixability. If the mole ratio of [NCO] is less than or equal to 1.0, ester of urea-modified polyester includes a smaller amount of urea, thereby resulting in degraded hot offset proof.

Polyester prepolymer (A) having an isocyanate group normally includes 0.5 through 40 wt % (part by weight) of polyisocyanate (PIC) compound components. It is preferable that the contained amount be between 1 and 30 wt %. In particular, the amount is preferably between 2 and 20 wt %. If the contained amount is less than 0.5 wt %, the hot offset proof is degraded, and additionally heat-resistant storage capability and low temperature fixability become poor. On the other hand, if the contained amount is larger than or equal to 40 wt %, the low temperature fixability is degraded.

For each molecule of polyester prepolymer (A) having isocyanate groups, one or more isocyanate groups are normally contained.

Preferably, the average number of contained isocyanate groups is between 1.5 and 3.0. Further preferably, the average number is between 1.8 and 2.5. If each molecule of polyester prepolymer (A) contains less than one isocyanate group, the molecular weight of urea-modified polyester becomes lower and the hot offset proof is degraded.

Amines (B) which react with polyester prepolymer (A) may be a divalent amine compound (B1), a tri- or more valent polyamine compound (B2), amino alcohol (B3), amino mercaptane (B4), amino acid (B5), B1 to B5 compounds which amino groups are blocked (B6), or the like.

The divalent amine compound (B1) may be aromatic diamine (phenylene diamine, diethyltoluene diamine, 4,4'-diaminodiphenyl methane or the like), alicyclic diamine (4,4'-diamino-3,3'-dimethyldicyclohexylmethane, diamine cyclohexane, isophoron diamine or the like), and aliphatic diamine (ethylene diamine, tetramethylene diamine, hexamethylene diamine or the like). The tri- or more valent polyamine compound (B2) may be diethylene triamine, triethylene tetramine or the like. The amino alcohol (B3) may be ethanol amine, hydroxyethyl aniline or the like. The amino marcaptane (B4) may be aminoethyl mercaptan, aminopropyl mercaptan, or the like. The amino acid (B5) may be amino propioic acid, amino caproic acid or the like. The B1 to B5 compounds which amino groups are blocked (B6) may be ketimine compounds and oxazolidine compounds which can be obtained from the amines and ketones (acetone, methylethyl ketone, methylisobutyl ketone or the like) of B1 through B5. The amines (B) are preferably B1 and a mixture of B1 and a small amount of B2.

The ratio of amines (B) is normally set between 1/2 and 2/1 as an equivalent ratio [NCO]/[NHx] of isocyanate groups [NCO] in polyester prepolymer (A) having isocyanate groups to amino groups [NHx] in amines (B). Preferably, the ratio is between 1.5/1 and 1/1.5. Further preferably, the ratio is between 1.2/1 and 1/1.2. If the ratio is greater than 2 or less than 1/2, the molecular weight of urea-modified polyester is lowered and the hot offset proof is degraded.

Modified polyester (i) for an image forming apparatus according to an embodiment of the present invention can be manufactured in accordance with a one-shot method or prepolymer method. The weight-average molecular weight of the modified polyester (i) is normally greater than 10,000. Preferably, the weight-average molecular weight is between 20,000 and 10,000,000. Further preferably, the weight-average molecular weight is between 30,000 and 1,000,000. The peak molecular weight is preferably between 1,000 and 10,000. If the peak molecular weight is less than 1,000, an elongation reaction less likely occurs and the toner has smaller elasticity. As a result, the hot offset proof is degraded. On the other hand, if the peak molecular weight is greater than 10,000, the fixability is lowered, and it becomes more difficult to properly manufacture the toner in the matter of particle formation and pulverization. The number-average molecular weight of the modified polyester (i), if unmodified polyester (ii) is used, is not limited. The modified polyester (i) may have any number-average molecular weight such that the weight-average molecular weight can be within the above-mentioned range. If only the modified polyester (i) is used, the number-average molecular weight is normally set as less than 20,000. Preferably, the number-average molecular weight is set between 1,000 and 10,000. Further preferably, the number-average molecular weight is between 2,000 and 8,000. If the number-average molecular weight is larger than 20,000, the low temperature fixability and the brightness for a full-color device are degraded.

In a bridge reaction and/or elongation reaction of polyester prepolymer (A) and amines (B), which is for generating modified polyester (i), a reaction terminating agent may be used as needed to adjust the molecular weight of obtained urea-modified polyester. Such a reaction terminating agent may be monoamine (diethylamine, dibutylamine, butylamine, lauryl amine or the like), and compounds thereof which amines are blocked compounds (ketimine compounds).

Unmodified Polyester

In the present invention, although only the modified polyester (i) can be used as described above, unmodified polyester (ii) together with the modified polyester (i) can be contained as a binder resin constituent. When the unmodified polyester (ii) is used together, it is possible to achieve better low temperature fixability and brightness for a full-color device than those obtained for use of only the modified polyester. The unmodified polyester (ii) may be polycondensation compounds of polyalcohol (PO) and polycarboxylic acid (PC) as in the above-mentioned polyester components of the modified polyester (i). The same materials as those of the modified polyester (i) are preferred. Also, the unmodified polyester (ii) may be compounds modified in chemical bonding other than urea bonding as well as unmodified polyester. For example, the polyester is modified in urethane bonding. It is preferable that at least a portion of both the modified and unmodified polyester (i) and (ii) is dissolved in terms of low temperature fixability and hot offset proof. Accordingly, the modified and unmodified polyester (i) and (ii) preferably have similar polyester compositions. If the unmodified polyester (ii) is included, the weight ratio of the modified polyester (i) to the unmodified polyester (ii) is normally set between 5/95 through 80/20. Preferably, the weight ratio is between 5/95 and 30/70. Moreover preferably, the weight ratio is between 5/95 and 25/75. In particular, the weight ratio is preferably between 7/93 and 20/80. If the weight ratio is less than 5%, the hot offset proof is degraded, and additionally the heat-resistant storage capability and the low temperature fixability become poor.

The peak molecular weight of the unmodified polyester (ii) is normally set between 1,000 and 10,000. Preferably, the peak molecular weight is between 2,000 and 8,000. Moreover preferably, the peak molecular weight is between 2,000 and 5,000. If the peak molecular weight is less than 1,000, the heat-resistant storage capability is degraded. On the other hand, if the peak molecular weight is greater than 10,000, the low temperature fixability is degraded. Also, the unmodified polyester (ii) has penta- or more valent hydroxyl groups. Moreover preferably, 10 through 120 valent hydroxyl groups are preferred. In particular, 20 through 80 valent hydroxyl groups are preferred. If the unmodified polyester (ii) has tetra- or less valent hydroxyl groups, the unmodified polyester (ii) is not preferred in terms of both the heat-resistant storage capability and the low temperature fixability. It is preferable that the acid value of the unmodified polyester be between one and five. Moreover preferably, the acid number is within two through four. Since high acid value wax is used, and low acid value binder is linked to electrification and high volume resistance, such unmodified polyester (ii) is suitable for toner used as a binary developer.

A glass transition point (Tg) of binder resin is normally set to be within 35 through 70° C. Preferably, Tg is within 55 through 65° C. If Tg is less than 35° C., the heat-resistant storage capability is degraded. On the other hand, if Tg is greater than 70° C., the low temperature fixability becomes insufficient. Urea-modified polyester is likely to be on the surfaces of obtained toner parent body particles. Accordingly, toner according to an embodiment of the present invention, even if the glass transition point is low, tends to show better heat-resistant storage capability than known polyester toner does.

Colorant

All known dyes and pigments are available as a colorant of toner according to an embodiment of the present invention. For example, such a colorant mat be carbon black, nigrosine dye, iron black, naphtol yellow-S, Hansa yellow (10G, 5G, G), cadmium yellow, yellow oxide, ocher, chrome yellow, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, colcothar, minium, lead vermilion, cadmium red, cadmium mercury red, antimony vermilion, permanent red 4R, para red, para-chloro-ortho-nitroaniline red, lithol fast scarlet G, brilliant fast scarlet, brilliant carmine BS, permanent red (F2R, F4R, FRL, FRLL, F4mRH), fast scarlet VD, brilliant scarlet G, lithol rubin GX, permanent red F5R, brilliant carmine 6B, pigment scarlet 3B, bordeaux 5B, toluidine maroon, permanent bordeaux F2K, helio bordeaux BL, bordeaux 10B, BON marron light, BON marron medium, eosine lake, rhodamine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, cerulean blue, alkali blue lake, peacock blue lake, Victoria blue lake, no metal-containing phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc white, Litobon and mixtures thereof. The containing amount of a colorant in toner is normally set between 1 and 15 weight percent. Preferably, the containing amount is between 3 and 10 weight percent.

A colorant may be used as masterbatch combined with resin. Such masterbatch may be manufactured from or mixed as binder resin together with: polystyrene, poly-p-chlorostyrene, styrenes such as polyvinyltoluene and substituted polymer thereof, copolymer of the above-mentioned compounds and vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butylal, polyacrylate resin, rosin, modified rosin, terpene resin, aliphatic or alicyclic hydrocarbon resin, aromatic petroleum resin, chlorinated paraffin, paraffin wax or the like. These materials can be used as a single material or a compound thereof.

Charge Control Agent

In the present invention, existing charge control agents are available. For example, the charge control agent may be nigrosin dye, triphenylmethane dye, chrome-containing metal complex dye, moribdate-chelated pigment, rhodamine dye, alkoxy amine, quaternary ammonium salt (including fluoride-modified quaternary ammonium salt), alkylamide, phosphorous or phosphorous-containing compounds, tungsten or tungsten-containing compounds, fluorinated active agent, metal salicylate, salicylate derivative metal salts or the like. Specifically, the charge control agent may be nigrosin dye BONTRON 03, quaternary ammonium salt BONTRON-P-51, metal-containing azo dye BONTRON S-34, oxynaphthate metal complex E-82, salicylate metal complex E-84, phenolic condensate E-89 (which are produced by Orient Chemical Industries Ltd.), molybdenum complex with quaternary ammonium salt TP-302 and TP-415 (which are produced by Hodogaya Chemical Co., Ltd.), quaternary ammonium salt copy charge PSY VP2038, triphenylmethane derivatives copy blue PR, quaternary ammonium salt copy charge NEG VP2036, copy charge NX VP434 (which are produced by Hoechst), LRA-901, boron complex LR-147 (which are produced by Japan Carlit Co., Ltd.), copper phthalocyanine, perylene, quinacridone, azo pigment, and high-molecular-weight-compounds having sulfonyl, carboxyl, or quaternary ammonium salt group. In particular, materials that can control toner to have negative polarity are preferably used.

The use amount of the charge control agent is determined depending on types of binder resin, presence of additives used as needed, and toner manufacturing methods including a dispersion method, and therefore cannot be not uniquely determined. However, the charge control agent is normally used within a weight part of 0.1 through 10 for the weight part 100 of binder resin. Preferably, the charge control agent is within a weight part of 0.2 through 5. If the weight is above 10, toner particles are electrified too much. As a result, the charge control agent becomes less effective, resulting in increasing electrostatic suction power with a developing roller, decreasing fixability of developer, and lowered image density.

Release Agent

Low melting point waxes, for example which have a melting point of 50 through 120° C., are available as a release agent. Such low melting point waxes effectively work as a release agent between a fixing roller and a toner boundary in dispersion with binder resin. Thereby, it is possible to realize effective high temperature offset without applying a release agent, such as oil, on the fixing roller. Such waxes may have the following constituents. Brazing filler metal and waxes may include waxes derived from plants, such as carnauba, cotton brazing filter metal, wood brazing filter metal, rice brazing filter metal, waxes derived from animals, such as yellow beeswax and lanolin, waxes derived from mineral substances, such as ozokerite and cercine, and petroleum waxes, such as paraffin wax, microcrystalline, and petrolatum. Apart from these natural waxes, synthesized hydrocarbon waxes, such as Fischer-Tropsch wax and polyethylene wax, and synthesized wax, such as ester, ketone and ether, may be used. In addition, aliphatic amide such as 12-hydroxystearate amide, amide stearate, imide phthalate anhydride and chlorinated hydrocarbon, crystalline polymer resin having low molecular weight homopolymer or copolymer such as poly-n-laurylmethacrylate and poly-n-stearylmethacrylate (for example, n-stearylacrylate-ethylmethacrylate copolymer), and crystalline polymer which side chain has long alkyl group may be used.

A charge control agent and a release agent together with masterbatch and binder resin may be fused and mixed, and may be dissolved and dispersed in organic solvent.

External Additives

Specifically, such inorganic particles may be formed of silica, alumina, titanium oxide, barium titanate, magnesium titanate, calcium titanate, strontium titanate, zinc oxide, tin oxide, silica sand, clay, mica, wollatonite, diatomite, chromium oxide, cerium oxide, colcothar, antimony trioxide, magnesium oxide, zirconium oxide, barium sulfate, barium carbonate, calcium carbonate, silicon carbide, silicon nitride or the like. Among these materials, hydrophobic silica particles and hydrophobic titanium oxide particles are used together as an agent to provide flowability. In particular, when these particles having an average diameter of less than $5\times10^{-2}$ μm are mixed, an electrostatic force and Van der Waals force with toner particles are considerably improved. As a result, even if such external additives are mixed with toner particles in a developing device to achieve a desired electrification level, it is possible to obtain a firefly-free good image without desorption of a flowability accelerator agent from toner particles, and further reduce an amount of remaining toner after transferring.

While titanium oxide fine particles have high environmental stability and image density stability, the titanium oxide fine particles have an insufficient electrification start feature. As a result, if more titanium oxide fine particles are contained than silica fine particles, this adverse effect becomes more influential. However, if hydrophobic silica particles and hydrophobic titanium oxide particles are contained within 0.3 through 1.5 wt %, a desired electrification start feature is obtained without significant damage. In other words, even if an image is repeatedly copied, it is possible to achieve stable image quality for each copy.

Preferred embodiments of a toner manufacturing method according to the present invention are described herein. However, the present invention is not limited to these embodiments.

Toner Manufacturing Method

1) To produce toner material liquid, colorant, unmodified polyester, polyester prepolymer having isocyanate group, and a release agent are dispersed in organic solvent.

From the viewpoint of removal after formation of toner source particles, it is preferable that the organic solvent be volatile and have a boiling point of less than 100° C. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, methylisobutylketone, and compounds thereof are available. In particular, aromatic solvent such as toluene and xylene, and chlorinated hydrocarbon such as methylene chloride, 1,2-dichloroethane, chloroform and carbon tetrachloride, are preferred. For 100 w/t parts of polyester prepolymer, 0 through 300 w/t parts of organic solvent are normally used. Preferably, 0 through 100 w/t parts are used. Further preferably, 25 through 70 w/t parts are used.

2) The toner material liquid together with a surface-active agent and resin fine particles is emulsified in aqueous solvent.

Such aqueous solvent may be water or organic solvent such as alcohol (methanol, isopropyl alcohol, ethylene glycol or the like), dimethyl formamide, tetrahydrofuran, cellosolves (methylcellosolve), lower ketones (acetone, methylethylketone or the like).

For 100 w/t parts of the toner material liquid, 50 through 2,000 w/t parts of aqueous solvent is normally used. The 100 through 1,000 w/t parts are preferred. If the part by weight of the aqueous solvent is less than 50, the toner material liquid is poorly dispersed, and thereby it is difficult to obtain toner particles having a predefined diameter. On the other hand, if the part by weight of the aqueous solvent is larger than 20,000, that is economically inefficient.

Also, for the purpose of good dispersion in aqueous solvent, a dispersion agent such as a surface-active agent and resin fine particles is added as needed.

Such a surface-active agent may be alkylbenzene sulfonate salt, &agr;- olefin sulfonate salt, anionic surfactant such as phosphate ester, alkyl amine salt, aminoalcohol fatty acid derivatives, polyamine fatty acid derivatives, amine salt such as imidazoline, alkyltrimethyl ammonium salt, dialkyldimethyl ammonium salt, alkyldimethylbenzyl ammonium salt, pyridinium salt, alkylisoquinolinium salt, cationic surfactant quaternary ammonium salt such as benzethonium chloride, fatty amide derivatives, non-ionic surfactant such as multivalent alcohol derivatives, and amphoteric surfactant such as alanine, dodecyl (aminoethyl) glycine, di(octylaminoethyl)glycine, N-alkyl-N,N-dimethylammonium betaine.

Also, even if a small amount of a surface-active agent having a fluoroalkyl group is used, the surface-active agent works well. Preferred anionic surfactant having fluoroalkyl group may be fluoroalkylcarboxylic acid having 2-10 carbon atoms and metal salt thereof, disodium perfluorooctanesulfonyl glutamate, sodium 3-[&ohgr;-fluoroalkyl (C6-C11) oxy]-1-alkyl (C3-C4) sulfonate, sodium 3-[&ohgr;-fluoroalkanoyl (C6-C8) oxy]-N-ethylamino]-1-propane sulfonate, fluoroalkyl (C11-C20) carboxylic acid and metal salts thereof, perfluoroalkylcarboxylic acid (C7-C13) and metal salts thereof, perfluoroalkyl (C4-C12) sulfonic acid and metal salt thereof, perfluorooctanesulfonic acid diethanolamide, N-propyl-N-(2-hydroxyethyl)-perfluorooctanesulfonamide, propyltrimethylammonium salt of a perfluoroalkyl (C6-C10) sulfonamide, salt of perfluoroalkyl (C6-C10)-N-ethylsulfonylglycine, monoperfluoroalkyl (C6-C16) ethyl phosphate ester or the like.

Commercially, Surflon S-111, S-112 and S113 (which are produced by Asahi Glass Co., Ltd.), Florad FC-93, FC-95, FC-98 and FC-129 (which are produced by Sumitomo 3M Ltd.), Unidyne DS-101 and DS-102 (which are produced by Daikin Industry Ltd.), Megaface F-110, F-120, F-113, F-191, F-812 and F-833 (which are produced by Dainippon Ink and Chemicals, Inc.), Ektop EF-102, EF-103, EF-104, EF-105, EF-112, EF-123A, EF-123B, EF-306A, EF-501, EF-201 and EF-204 (which are produced by Tohkem products), and Ftergent F-100 and F-150 (which are produced by Neos) are available.

Also, a cationic surfactant may be aliphatic primary or secondary amino acid having fluoroalkyl group, aliphatic quaternary ammonium salt such as ammonium salt of perfluoroalkyl (C6-C10) sulfonamide propyltrimethyl, benzalkonium salt, benzethonium chloride, pyridinium salt, imidazolinium salt, commercially, Surflon S-121, Florad FC-135, Unidyne DS-202, Megaface F-150 and F-824, Ektop EF-132, Ftergent F-300 or the like.

Resin fine particles are added to stabilize toner source particles formed in aqueous solvent. The resin fine particles are preferably added such that the coverage ratio thereof on the surface of a toner source particle can be within 10 through 90%. For example, such resin fine particles may be methyl polymethacrylate particles of 1 μm and 3 μm, polystyrene particles of 0.5 μm and 2 μm, poly(styrene-acrylonitrile)particles of 1 μm, commercially, PB-200 (which is produced by Kao Co.), SGP, SGP-3G (Soken), technopolymer SB (Sekisui Plastics Co., Ltd.), micropearl (Sekisui Chemical Co., Ltd.) or the like.

Also, an inorganic dispersant such as calcium triphosphate, calcium carbonate, titanium oxide, colloidal silica, and hydroxyapatite may be used.

To make dispersed drops stable, polymer protective colloid may be used together with the above-mentioned resin fine particles and inorganic dispersant. For example, acid compounds such as acrylic acid, methacrylic acid, a-cyanoacrylic acid, a-cyanomethacrylic acid, itaconic acid, crotonic acid, fumaric acid, maleic acid and maleic anhydride, or (meth)acrylic monomer with a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, ester from diethylene glycol and monoacrylic acid, ester from diethylene glycol and monomethacrylic acid, ester from glycerin and monoacrylic acid, ester from glycerin and monomethacrylic acid, N-methylolacrylamide and N-methylolmethacrylamide, vinyl alcohol or ethers from vinyl alcohol such as vinylmethyether, vinylethylether and vinylpropylether, esters from vinylalcohol and compound having carboxylic group such as vinyl acetate, vinyl propionate and vinyl lactate, acrylamide, methacrylamide, diacetoneacrylamide or methylol compounds thereof, acid chlorides such as acryloyl chloride and methacrylate chloride, nitrogen-containing compounds such as vinylpyridine, vinylpyrrolidone, vinylimidazol and ethyleneimine, homopolymer or co-polymer having heterocycles thereof, polyoxyethylene-based ones such as polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearyl phenyl ester and polyoxyethylene nonyl phenyl ester, and celluloses such as methyl cellulose, hydroxyethyl cellulose and hydroxypropyl cellulose, are available.

The present invention is not limited to any certain dispersion method. Well-known techniques, such as low-speed shred type, high-speed shred type, friction type, high-pressure jet type and ultrasonic type, are available. In particular, the high-speed shred type dispersion apparatus is preferred to obtain dispersed particles having a diameter of 2 through 20 μm. If such a high-speed shred type dispersion apparatus is used, the rotation speed is not limited. However, the rotation speed is normally set within 1,000 through 30,000 rpm. Preferably, the rotation speed is within 5,000 through 20,000 rpm. Also, although the dispersion time is not limited to a certain time period, the dispersion time is normally set within 0.1 through 5 minutes for a batch method. The temperature during dispersion is normally kept between 0 and 150° C. (under pressure). Preferably, the temperature is kept between 40 and 98° C.

3) During production of emulsion liquid, amines (B) are added to react with polyester prepolymer (A) having isocyanate group.

This reaction involves bridge and/or elongation of molecule chain. The reaction time is determined depending on reactivity of the structure of the isocyanate group of the polyester prepolymer (A) and the amines (B). The reaction time is normally set between 10 minutes and 40 hours. Preferably, the reaction time is set between 2 and 24 hours. In addition, existing catalysts may be used as needed. Specifically, dibutyl tin laurate, dioctyl tin laurate or the like are available.

4) After completion of the reaction, organic solvent is removed from the emulsified dispersed reactant, and subsequently the resulting material is cleaned and dried to obtain toner source particles. To remove the organic solvent, for example, the emulsified dispersed reactant is gradually heated while laminar flow is stirred. After brisk stirring in a certain temperature range, it is possible to produce spindle-shaped toner source particles by removing the organic solvent. Also, if acids such as calcium phosphates or alkali soluble materials are used as a dispersion stabilizing agent, such calcium phosphates are dissolved by using acids such as hydrochloric acid, and then the resulting material is cleaned by using water so as to remove the calcium phosphates from the toner source particles. The removal may be conducted through enzyme decomposition.

5) A charge control agent is provided to the obtained toner source particles. Then, inorganic particles such as silica particles and titanium oxide particles are added to obtain toner.

In accordance with a well-known method, for example, a method using a mixer, the charge control agent is provided, and the inorganic particles are added.

According to the above-mentioned toner manufacturing method, it is possible to easily obtain toner particles having a small diameter and a sharp diameter distribution. Furthermore, if emulsified dispersed reactant is intensively stirred during a removal process of organic solvent, it is possible to control the shape of toner source particles between true spherical shape and spindle shape. Moreover, it is possible to control surface morphology between smooth surface and rough surface.

Toner according to an embodiment of the present invention has an almost spherical shape as in the following shape definition.

Figure 6A:
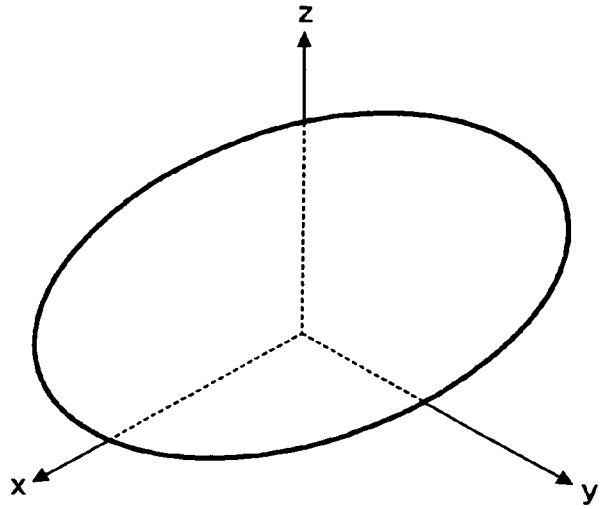
FIGS. 6A, 6B, and 6C show exemplary shapes of a toner particle according to an embodiment of the present invention.
Figure 6B:
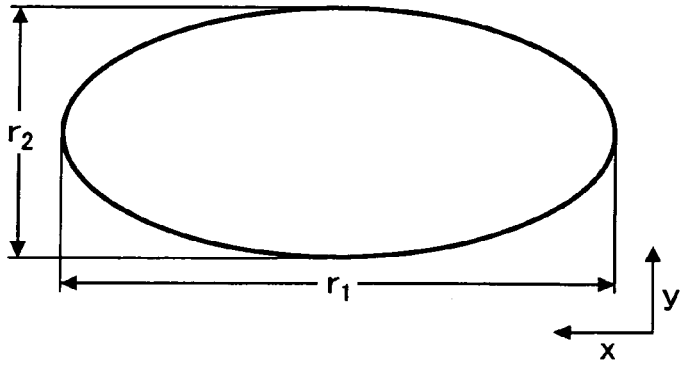
Figure 6C:
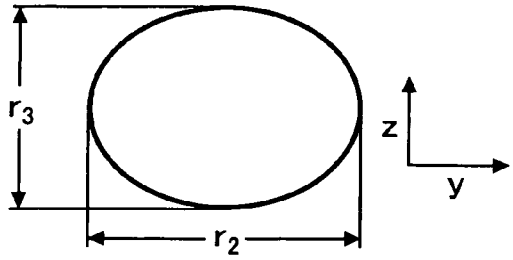

FIGS. 6A through 6C are schematic views showing an exemplary shape of a toner particle according to an embodiment of the present invention.

Referring to FIGS. 6A through 6C, such an almost spherical toner particle is defined by the major axial length r1, the minor axial length r2, and the thickness r3 (r1≧r2≧r3). A toner particle according to the present invention preferably has a shape such that the ratio of the minor axial length r2 to the major axial length r1 (r2/r1) is between 0.5 and 1.0, and the ratio of the thickness r3 to the minor axial length r2 (r3/r2) is between 0.7 and 1.0. If the ratio (r2/r1) is less than 0.5, the toner particle is substantially different from true spherical shape. As a result, it is difficult to obtain high-quality images because of insufficient dot reproducibility and transfer efficiency. Also, if the ratio (r2/r1) is less than 0.7, the toner particle has a nearly flat shape. As a result, it is difficult to achieve a high transfer rate unlike a spherical toner particle. In particular, if the ratio (r3/r2) is equal to 1.0, the toner particle has a body of rotation. As a result, it is possible to improve toner flowability.

It is noted that the lengths r1, r2 and r3 are measured by taking pictures of the toner particle from different viewing angles by using a scanning electron microscope (SEM).

Toner manufactured in this manner can be used as single-component magnetic toner without magnetic carrier or non-magnetic toner.

Also, if the manufactured toner is used in two-component developer, the toner may be mixed with magnetic carrier. Such magnetic carrier may be a ferrite containing divalent metal such as iron, magnetite, manganese, zinc and copper, and preferably has a volume average particle diameter of 20 through 100 μm. If the average particle diameter is less than 20 μm, it is likely that carrier may be attached on the photoconductor 1 during development. On the other hand, if the average diameter is larger than 100 μm, toner particles are insufficiently electrified because of an unsatisfactory mixture. In this case, when the developing device is continuously operated, there is a risk that electrification may malfunction. Also, zinc-containing Cu ferrite is preferred because of high saturation magnetization. However, ferrite may be selected depending on a process of the image forming apparatus 100. Magnetic carrier covering resin is not limited to a certain resin. For example, the magnetic carrier covering resin may be silicone resin, styrene-acryl resin, fluorine-contained resin, olefin resin or the like. The magnetic carrier covering resin may be manufactured by dissolving coating resin in solvent and spaying the resulting solution in a fluidized bed to coat the resin on a core. Alternatively, after resin particles are electrostatically attached to core particles, the resulting particles may be melt for the coverage. The thickness of the covered resin is normally between 0.05 and 10 μm, and preferably between 0.3 and 4 μm.

Obviously, numerous modifications and variations of the present invention are possible in light of the above teachings. It is therefore to be understood that within the scope of the appended claims, the present invention may be practiced otherwise than as specifically described herein.

The invention claimed is:

1. A cleaning device for cleaning a surface of an image support body, comprising:

a cleaning blade disposed in contact with the surface of the image support body;

an lubricant agent applying part configured to apply a solid lubricant agent to the surface of the image support body, said lubricant agent applying part disposed in an upstream side from the cleaning blade with respect to a rotational direction of the image support body; and a toner removing part configured to remove toner particles, said toner removing part disposed in an upstream side from the lubricant agent applying part with respect to the rotational direction of the image support body and including a roller rotating in an opposite direction of the image support body.

2. The cleaning device as claimed in claim 1, wherein toner removing ability of the toner removal part is higher than that of the lubricant applying part.

3. A process cartridge for an image forming apparatus, wherein the process cartridge is detachably mounted in the image forming apparatus, comprising:

an image support body configured to support a latent image; and a cleaning part configured to clean a surface of the image support body after transferring, said cleaning part comprising:

a cleaning blade disposed in contact with the surface of the image support body;

a lubricant agent applying part configured to apply a solid lubricant agent to the surface of the image support body, said lubricant agent applying part disposed in an upstream side from the cleaning blade with respect to a rotational direction of the image support body; and a toner removing part configured to remove toner particles, said toner removing part disposed in an upstream side from the lubricant agent applying part with respect to the rotational direction of the image support body and including a roller rotating in an opposite direction of the image support body.

4. An image forming apparatus, comprising:

an image support body configured to support a latent image;

an electrifying part configured to electrify a surface of the image support body uniformly;

an exposing part configured to expose the electrified surface of the image support body based on image data to write a latent image;

a developing part configured to develop the latent image to be visible by supplying toner particles to the latent image formed on the surface of the image support body;

a transferring part configured to transfer the visible image on the surface of the image support body onto a transferring medium; and a cleaning part configured to clean the surface of the image support body after the transferring, wherein the cleaning part comprises:

a cleaning blade disposed in contact with the surface of the image support body;

a lubricant agent applying part configured to apply a solid lubricant agent to the surface of the image support body, said lubricant agent applying part disposed in an upstream side from the cleaning blade with respect to a rotational direction of the image support body; and a toner removing part configured to remove toner particles, said toner removing part disposed in an upstream side from the lubricant agent applying part with respect to the rotational direction of the image support body and including a roller rotating in an opposite direction of the image support body.

5. An image forming apparatus as claimed in claim 4, wherein the electrifying part is further configured to electrify a DC and AC bias voltages on a surface of the image support body.

6. The image forming apparatus as claimed in claim 4, wherein an average roundness of the toner particles is greater than or equal to 0.93 and smaller than or equal to 1.00.

7. The image forming apparatus as claimed in claim 4, wherein the toner particles have a ratio of volume average particle diameter (Dv) to a number average particle diameter (Dn), Dv/Dn, between 1.00 through 1.40.

8. The image forming apparatus as claimed in claim 4, wherein the toner particles have a shape defined by a major axial length r1, a minor axial length r2, and a thickness r3, where r1≧r2≧r3 and ratios r2/r1 and r3/r2 are between 0.5 and 1.0 and between 0.7 and 1.0, respectively.

9. Toner for development of an electrophotography process of an image forming apparatus including a cleaning part configured to clean a surface of an image support body after transferring, wherein the cleaning part includes:

a cleaning blade disposed in contact with the surface of the image support body;

a lubricant agent applying part configured to apply a solid lubricant agent to the surface of the image support body, said lubricant agent applying part disposed in an upstream side from the cleaning blade with respect to a rotational direction of the image support body; and a toner removing part configured to remove toner particles, said toner removing part disposed in an upstream side from the lubricant agent applying part with respect to the rotational direction of the image support body and including a roller rotating in an opposite direction of the image support body.

10. The toner as claimed in claim 9, wherein the toner is prepared by a method comprising: dispersing or dissolving toner constituents comprising a polyester prepolymer having a functional group having a nitrogen atom, a polyester resin, a colorant, and a release agent in an organic solvent to prepare a toner constituent liquid; and dispersing the toner constituent liquid in an aqueous medium having a compound capable of reacting the functional group of the polyester prepolymer to perform at least one of a crosslinking reaction and an elongation reaction of the polyester prepolymer and to form toner particles in the aqueous medium.

11. The toner as claimed in claim 10, wherein an average roundness of the toner particles is greater than or equal to 0.93 and smaller than or equal to 1.00.

12. The toner as claimed in claim 10, wherein the toner particles have a ratio of volume average particle diameter (Dv) to a number average particle diameter (Dn), Dv/Dn, between 1.00 through 1.40.

13. The toner as claimed in claim 10, wherein the toner particles have a shape defined by a major axial length r1, a minor axial length r2, and a thickness r3, where r1≧r2≧r3 and ratios r2/r1 and r3/r2 are between 0.5 and 1.0 and between 0.7 and 1.0, respectively.

14. A cleaning device for cleaning a surface of an image support body, comprising:

means for cleaning the surface of the image support body;

means for applying a solid lubricant agent to the surface of the image support body, and disposed in an upstream side from the means for cleaning with respect to a rotational direction of the image support body; and means for removing toner particles, and disposed in an upstream side from the means for applying with respect to the rotational direction of the image support body, and including a roller rotating in an opposite direction of the image support body.

15. A cleaning device for cleaning a surface of an image support body, comprising:

a cleaning blade disposed in contact with the surface of the image support body;

an lubricant agent applying part configured to apply a solid lubricant agent to the surface of the image support body, said lubricant agent applying part disposed in an upstream side from the cleaning blade with respect to a rotational direction of the image support body; and a toner removing part configured to remove toner particles, said toner removing part disposed in an upstream side from the lubricant agent applying part with respect to the rotational direction of the image support body, wherein the lubricant agent applying part comprises straight brushes, and the toner removing part comprises a roller of loop brushes.

16. The cleaning device as claimed in claim 15, wherein toner removing ability of the toner removal part is higher than that of the lubricant applying part.

17. The cleaning device as claimed in claim 15, wherein the straight brushes and the loop brushes comprise electroconductivity fibers.

18. The cleaning device as claimed in claim 15, wherein the toner removing part further comprises a flicker in contact with the loop brushes.

19. The cleaning device as claimed in claim 15, wherein the loop brush roller is rotatable in an opposite direction with respect to a rotation direction of the image support body at an abutment position with the image support body.

20. A process cartridge for an image forming apparatus, wherein the process cartridge is detachably mounted in the image forming apparatus, comprising:

an image support body configured to support a latent image; and a cleaning part configured to clean a surface of the image support body after transferring, said cleaning part comprising:

a cleaning blade disposed in contact with the surface of the image support body;

a lubricant agent applying part configured to apply a solid lubricant agent to the surface of the image support body, said lubricant agent applying part disposed in an upstream side from the cleaning blade with respect to a rotational direction of the image support body; and a toner removing part configured to remove toner particles, said toner removing part disposed in an upstream side from the lubricant agent applying part with respect to the rotational direction of the image support body, wherein the lubricant agent applying part comprises straight brushes, and the toner removing part comprises a roller of loop brushes.

21. An image forming apparatus, comprising:

an image support body configured to support a latent image;

an electrifying part configured to electrify a surface of the image support body uniformly;

an exposing part configured to expose the electrified surface of the image support body based on image data to write a latent image;

a developing part configured to develop the latent image to be visible by supplying toner particles to the latent image formed on the surface of the image support body;

a transferring part configured to transfer the visible image on the surface of the image support body onto a transferring medium; and a cleaning part configured to clean the surface of the image support body after the transferring, wherein the cleaning part comprises:

a cleaning blade disposed in contact with the surface of the image support body;

a lubricant agent applying part configured to apply a solid lubricant agent to the surface of the image support body, said lubricant agent applying part disposed in an upstream side from the cleaning blade with respect to a rotational direction of the image support body; and a toner removing part configured to remove toner particles, said toner removing part disposed in an upstream side from the lubricant agent applying part with respect to the rotational direction of the image support body, wherein the lubricant agent applying part comprises straight brushes, and the toner removing part comprises a roller of loop brushes.

22. An image forming apparatus as claimed in claim 21, wherein the electrifying part is further configured to electrify a DC and AC bias voltages on a surface of the image support body.

23. The image forming apparatus as claimed in claim 21, wherein an average roundness of the toner particles is greater than or equal to 0.93 and smaller than or equal to 1.00.

24. The image forming apparatus as claimed in claim 21, wherein the toner particles have a ratio of volume average particle diameter (Dv) to a number average particle diameter (Dn), Dv/Dn, between 1.00 through 1.40.

25. The image forming apparatus as claimed in claim 21, wherein the toner particles have a shape defined by a major axial length r1, a minor axial length r2, and a thickness r3, where r1≧r2≧r3, and ratios r2/r1 and r3/r2 are between 0.5 and 1.0 and between 0.7 and 1.0, respectively.

26. Toner for development of an electrophotography process of an image forming apparatus including a cleaning part configured to clean a surface of an image support body after transferring, wherein the cleaning part includes:

a cleaning blade disposed in contact with the surface of the image support body;

a lubricant agent applying part configured to apply a solid lubricant agent to the surface of the image support body, said lubricant agent applying part disposed in an upstream side from the cleaning blade with respect to a rotational direction of the image support body; and a toner removing part configured to remove toner particles, said toner removing part disposed in an upstream side from the lubricant agent applying part with respect to the rotational direction of the image support body, wherein the lubricant agent applying part comprises straight brushes, and the toner removing part comprises a roller of loop brushes.

27. The image forming apparatus according to claim 26, wherein the toner is prepared by a method comprising: dispersing or dissolving toner constituents comprising a polyester prepolymer having a functional group having a nitrogen atom, a polyester resin, a colorant, and a release agent in an organic solvent to prepare a toner constituent liquid; and dispersing the toner constituent liquid in an aqueous medium having a compound capable of reacting the functional group of the polyester prepolymer to perform at least one of a crosslinking reaction and an elongation reaction of the polyester prepolymer and to form toner particles in the aqueous medium.

28. The toner as claimed in claim 26, wherein an average roundness of the toner particles is greater than or equal to 0.93 and smaller than or equal to 1.00.

29. The toner as claimed in claim 26, wherein the toner particles have a ratio of volume average particle diameter (Dv) to a number average particle diameter (Dn), Dv/Dn, between 1.00 through 1.40.

30. The toner as claimed in claim 26, wherein the toner particles have a shape defined by a major axial length r1, a minor axial length r2, and a thickness r3, where r1≧r2≧r3 and ratios r2/r1 and r3/r2 are between 0.5 and 1.0 and between 0.7 and 1.0, respectively.

31. A cleaning device for cleaning a surface of an image support body, comprising:

means for cleaning the surface of the image support body;

means for applying a solid lubricant agent to the surface of the image support body, and disposed in an upstream side from the means for cleaning with respect to a rotational direction of the image support body; and means for removing toner particles, and disposed in an upstream side from the means for applying with respect to the rotational direction of the image support body, wherein the means for applying a solid lubricant agent comprises straight brushes, and the means for removing toner particles comprises a roller of loop brushes.

* * * * *